US005362573A

United States Patent [19]

Pandian et al.

[11] Patent Number: 5,362,573

[45] Date of Patent: Nov. 8, 1994

[54] USE OF ZIRCONIUM SALTS TO IMPROVE THE SURFACE SIZING EFFICIENCY IN PAPER MAKING

[76] Inventors: Vernon E. Pandian, 3684 Twinberry Pl., Corvallis, Oreg. 97330; Dan van Calcar, 2036 Myrtle Ave. NE, Salem, Oreg. 97303; Bernard W. Wolff, 402 Cherokee St., Marietta, Ga. 30060

[21] Appl. No.: 11,488

[22] Filed: Jan. 28, 1993

[51] Int. Cl.[5] ..... B32B 23/08; B32B 27/10

[52] U.S. Cl. ..... 428/511; 427/341; 427/342; 427/391; 428/514

[58] Field of Search ..... 427/342, 391, 395; 428/511, 514, 341

[56] References Cited

U.S. PATENT DOCUMENTS

| | | | |
|---|---|---|---|
| 2,780,555 | 2/1957 | Budewitz | 106/208 |
| 3,332,794 | 7/1967 | Hart | 106/194 |
| 3,930,074 | 12/1975 | Drelich et al. | 427/342 X |
| 4,234,212 | 11/1980 | Kato et al. | 427/152 X |
| 4,400,440 | 8/1983 | Shaw | 427/209 X |

*Primary Examiner*—Michael Lusignan
*Attorney, Agent, or Firm*—Cort Flint

[57] ABSTRACT

This invention relates to an improved process of surface sizing of paper and paperboard. The process consists of:

a) Preparing an aqueous surface sizing compound by combining and mixing an aqueous solution of at least one water soluble or dispersible polymer or interpolymer, a solution or dispersion of auxiliary materials, and an aqueous solution of a metal salt, selected from the group of metals consisting of zirconium, hafnium or titanium, to the polymer solution;

b) Adjusting the pH of the aqueous sizing compound from about 5 to about 10.5 by the addition of alkali, thereby increasing the molecular weight of the polymer or interpolymer by chemically or physically reacting the polymer or interpolymer with the salt of zirconium, hafnium or titanium, resulting in an increase in viscosity of the aqueous sizing compound;

c) Applying the aqueous surface sizing compound to the surface of the paper or paperboard by means of a coating device, where the aqueous surface sizing compound is immobilized in the wet state, thereby preventing penetration of the aqueous surface sizing compound into the paper or paperboard; and d) Drying and curing the aqueous surface sizing compound by applying heat to the treated paper or paperboard thereby crosslinking the polisher or interpolymer contained in the surface sizing compound, and also forming bonds with the pigment particles and fiber present at the surface of the paper or paperboard, and thereby anchoring the polymer or interpolymer to the surface of the paper or paperboard.

19 Claims, No Drawings

USE OF ZIRCONIUM SALTS TO IMPROVE THE SURFACE SIZING EFFICIENCY IN PAPER MAKING

FIELD OF THE INVENTION

This invention relates to an improved process of surface sizing of paper and paperboard that prevents the surface size polymer from penetrating into the paper and paperboard before it is dried and cured, thereby sealing the surface of the paper and paperboard and preventing dusting and linting of the paper and paperboard during further processing.

BACKGROUND OF THE INVENTION

Although many functional chemicals can be added to the wet end of the paper machine as internal sizes, some grades of paper require special properties that cannot be provided by the low levels of additives that are retained at the wet end of the paper machine. An example is a high quality printing and writing grade of paper or paperboard requiring high levels of surface size to provide good printing characteristics, as well as a high surface strength. To achieve the properties required for these grades of paper, it is necessary to apply the chemicals to a preformed paper web, also called surface sizing.

The most common method for the application of chemicals to the surface of a paper web is by a size applicator, such as a size press or a calender water box. In the size press, dry paper is passed through a flooded nip and a solution or dispersion of the functional chemicals contact both sides of the paper. Excess liquid is squeezed out in the press and the paper is redried and cured.

The most commonly used materials for surface sizing of paper and paperboard are water soluble or water dispersible polymers, such as starches and modified starches, polyvinyl alcohols, styrene-maleic anhydride interpolymers and other carboxylated polymers, alkylketene-dimer emulsions, carboxymethyl cellulose, polyurethanes, epoxies and the like, either alone or in mixtures of two or more of these polymers. Other additives such as defoamers, pigments, alkali, and the like are also often added to the treatment solution.

Surface sizing is applied to paper or paperboard to improve various properties of the sheet to render it suitable for the end application. Typical properties imparted by surface size treatment to the paper sheet, after drying and curing, include improved resistance of the surface to moisture, enhanced strength, improved bonding of the cellulosic fibers to prevent subsequent linting, as well as preventing the loss by dusting of the mineral powders that are often added at the wet end of the paper machine to enhance optical properties and also lowering the cost of the final paper sheet. Other important properties of the paper sheet, such as reduced porosity, enhanced ink holdout when printed, and reduction of curl of the sheet can also be achieved by surface sizing.

Surface sizing of paper and paperboard also plays an even more important role when no internal size is used as is often the case, or when certain synthetic internal sizes are used, as is typical for papers made under neutral or alkaline pH conditions. On the other hand, certain synthetic internal sizes, if used at high dosage levels, can cause problems in the operation of the paper machine because of slipperines and hydrolysis of the internal size, and in the reduced quality of the produced paper sheet. These problems can be eliminated by using to the maximum extent possible surface sizing as an alternative to internal sizing. As already mentioned above, surface sizing is applied to beth sides of paper and paperboard.

A major disadvantage limiting the efficiency of a surface size is its tendency to penetrate excessively the paper or paperboard sheet when certain internal sizing agents with slow rates of internal sizing development are used. This reduces the effectiveness of the surface size, because less of the surface size is deposited at the surface of the paper or board sheet, thereby requiring that higher pickup levels be used. It also places more reliance on the internal size to provide sizing levels required of the paper sheet. When salts of carboxylated polymers are used in the surface size in addition to water soluble hydroxylated polymers, i.e., polymers containing hydroxygroups, extra large addition levels are needed to compensate for this penetration. The reduced concentration of the surface sizing compound at the surface of the sheet can result in paper sheet problems. Other problems are caused by the large amount of carboxylated polymers necessary to overcome the effect of penetration into the sheet, a common problem being the generation of foam. Foam reduces pickup of the surface sizing compound, causes defects on the paper surface, and interferes with the efficient operation of the paper machine. Carboxylated polymers are also more expensive than hydroxylated polymers, such as starch, and their use should be minimized for that reason.

There has been found a way to improve the surface holdout of the surface size by adding a group IV of the periodic system of elements metal salt, for example ammonium zirconium carbonate (AZC) to the surface sizing compound to maximize its effect. Other group IV metal salts useful in the instant invention are those of hafnium and titanium. Zirconium salts have previously been suggested, for example, in U.S. Pat. No. 4,400,440 issued to Shaw, as well as in Brit. Patent 1,024,881 issued to the Inveresk Paper Company, to impart property improvements when used in conjunction with emulsion polymers for significantly improved block resistance of a pigmented coating composition that was heated and cured to crosslinking the coating binder. Zirconium salts have also been suggested as migration inhibitors for non-woven binders as taught in U.S. Pat. No. 3,930,074 issued to Drelich.

SUMMARY OF THE INVENTION

It has now been found that the addition of a zirconium salt to an aqueous surface sizing compound overcomes the difficulties presently associated with the surface sizing of paper and paperboard. The addition of a zirconium salt to the aqueous surface sizing compound not only results in crosslinking the water soluble or water dispersible polymer on drying and curing, i.e., by the elimination of water from the surface of the paper or paperboard, but the zirconium salt also immobilizes the surface sizing compound in the wet state by complex formation with the polymer in the surface sizing compound, and thereby prevents its penetration into the paper or paperboard sheet in the wet state before the sheet enters the drying section of the paper machine. This results in a more efficient use of the surface sizing compound resulting in improved properties as later described in more detail. The instant invention consists of a multistep process to make and apply the surface sizing compound as follows:

a) Preparing an aqueous surface sizing compound by combining and mixing an aqueous solution of at least one water soluble or dispersible polymer or interpolymer, a solution or dispersion of auxiliary materials, and an aqueous solution of a metal salt, selected from the group of metals consisting of zirconium, hafnium or titanium, to the polymer solution;

b) Adjusting the pH of the aqueous sizing compound from about 5 to about 10.5 by the addition of alkali, thereby increasing the molecular weight of the polymer or interpolymer by chemically or physically reacting the polymer or interpolymer with the salt of zirconium, hafnium or titanium, resulting in an increase in viscosity of the aqueous sizing compound;

c) Applying the aqueous surface sizing compound to the surface of the paper or paperboard by means of a coating device, where the aqueous surface sizing compound is immobilized in the wet state, thereby preventing penetration of the aqueous surface sizing compound into the paper or paperboard; and d) Drying and curing the aqueous surface sizing compound by applying heat to the treated paper or paperboard thereby crosslinking the polymer or interpolymer contained in the surface sizing compound, and also forming bonds with the pigment particles and fiber present at the surface of the paper or paperboard, and thereby anchoring the polymer or interpolymer to the surface of the paper or paperboard.

DETAILED DESCRIPTION OF THE INVENTION

The above and related objects of this invention are achieved through the addition of a zirconium, hafnium or titanium salt to the surface sizing compound. The zirconium salts that may be employed are water soluble. Examples of these salts include: ammonium zirconium carbonate (AZC); ammonium zirconium sulfate; ammonium zirconium lactate; ammonium zirconium glycolate; zirconium oxynitrate; zirconium nitrate; zirconium hydroxychloride; zirconium orthosulfate; zirconium acetate; potassium zirconium carbonate(KZC); zirconium mandelate; tripotassium zirconium sulfate; trisodium zirconium carbonate; zirconium glycolate; monosodium zirconium glycolate; zirconium sulfate; zirconium carbonate, and the like. The equivalent hafnium or titanium salts may also be used. Generally, 0.15 percent to 1.5 percent of zirconium dioxide, based on the dry weight of the watersoluble or dispersible polymers, are being added as its salt, preferably 0.2 to 1 percent of zirconium dioxide as its salt. If, for example, ammonium zirconium carbonate(AZC) is used as the zirconium compound, the amounts added on the dry weight of the watersoluble or dispersible polymers would be 0.85 percent to 8.5 percent, preferably 1.1 percent to 5.6 percent. Hafnium typically is found in conjunction with zirconium, and as a result, AZC and other zirconium salts typically contain a small percentage of hafnium compounds. Hafnium has chemical properties similar to zirconium. Accordingly, any comments applicable to zirconium based products described in the instant invention apply to hafnium as well. Titanium salts may be used in equivalent amounts.

Starch is primarily used as the water soluble hydroxylated polymer in the surface sizing compound. Examples of starches are: corn starch, potato starch, rice starch; tapioca starch; convened starches, either by means of enzymes, acid or persulfate treatments; dextrin; modified starches include ethylated starch, propylated starch or butylated starch; cyanoethylated starch; cationic starch; acetylated starch; oxidized starch and the like. Other water soluble hydroxylated polymers that may be used are carbohydrates such as alginates; carrageenan; guar gum; gum arabic; gum ghatti; gum karaya; gum tragacanth; locust bean gum; pectins; xanthan gum; tamarind gum; and the like. Modified cellulosic gums such as carboxylated cellulose, such as carboxymethyl cellulose (CMC), and hydroxyalkyl cellulose, such as hydroxyethyl cellulose, may be employed as the water soluble polymer. Water soluble polymers containing amide, lactone, pyrrolidinone or imidazolinone groups may also be used in the surface sizing compound. Synthetic water soluble hydroxylated polymers such as fully- and partially hydrolyzed polyvinyl alcohols can also be used.

Salts of carboxylated polymers such as salts of low molecular weight polyacrylic acid or polymethacrylic acid, the ammonium and sodium salts of styrene-maleic anhydride interpolymers ($NH_4$ SMA and Na SMA respectively), salts of styrene-acrylic acid interpolymers, of ethylene-acrylic or methacrylic acid interpolymers, salts of vinyl acetate-crotonic acid interpolymers; polymeric additives, such as water soluble or dispersible urethane-, polyester- and epoxy polymers, and the like, can be used alone or in conjunction with starches and other hydroxylated polymers, such as polyvinyl alcohols. In case they are used as additives to starch or polyvinyl alcohol, these compounds are generally employed in a ratio of 0.5 to 99.5, preferably in a ratio of 4 to 96, to starch or polyvinyl alcohol.

If starch or modified starch alone is used as the water soluble hydroxylated polymer in the surface sizing compound, a zirconium salt such as ammonium zirconium carbonate (AZC) or potassium zirconium carbonate (KZC) is added in the appropriate amount after the starch is dissolved. If polyvinyl alcohol is used instead of starch, the appropriate amount of zirconium salt is added to the surface sizing compound based upon the dry content of the polyvinyl alcohol, after dissolution of the polyvinyl alcohol.

If a synthetic water soluble polymer such as a salt of a styrene maleic anhydride interpolymer (SMA) is used in combination with starch or polyvinyl alcohol or other hydroxylated polymers, the appropriate amount of the zirconium salt is added based on the total dry content of the starch, the carboxylated polymer and the other components of the surface sizing compound other than the zirconium salt. The zirconium salt should always be added as an aqueous solution after make-up of the surface sizing compound. The exact amount of the zirconium salt, that is desirable, can vary depending upon the concentration of the zirconium salt solution, and the speed of immobilization and crosslinking required for the respective application.

Auxiliary materials may be added to the surface sizing compound such as defoamers, bacteriocides, pigments, alkali, and the like as required. Often pigments such as number 1 filler clay are added to the surface sizing compound to obtain additional opacity, as well as cost savings of the treated paper or paperboard sheet. Other pigments which are suitable are, for example, calcium carbonate, titanium dioxide, silica, and talk. When pigments are used in such a way, the amount can vary from 0 to 70 percent, preferably, from 20 to 50 percent based on the weight of the water soluble or dispersible polymer in the surface sizing compound. The surface sizing compound is adjusted to a pH of 5 to 10.5. Preferably, when 100 percent starch or polyvinyl alcohol is used as the water soluble polymer, the pH should be adjusted from 5 to 8. When an ammonium salt of a carboxylated polymer is present in the surface sizing compound, the pH should be adjusted from 7.5 to 9, for the potassium or sodium salt from 6 to 9. The pH adjustment should be made with alkali such as ammonia, sodium hydroxide, sodium carbonate, potassium hydroxide and the like.

The aqueous surface sizing compound of the instant invention for sizing paper or paperboard consists essentially of

| | |
|---|---|
| 50–70 parts | water soluble hydroxylated polymer |
| 0–7 parts | water soluble carboxylated polymer |
| 0.3–3 parts | alkali salt of zirconium carbonate (calculated as $ZrO_2$) |
| 0–7 parts | polymeric additive |
| 0–2 parts | aqueous alkali |
| 0–80 parts | pigment |

and enough water to obtain from 1.5 to 20 percent total solids, and, optionally, a small amount of defoamer.

The preparation of the surface sizing compound is done in a conventional kettle equipped with heating and cooling means, and an agitator. The water to dissolve the dry polymer or mixture of polymers is added first, the polymer powder is sifted in and the water is heated to the appropriate temperature to effect dissolution of the polymer. Where a concentrated solution or dispersion of the polymer is available, that can be added at this point also. The batch is then cooled, the pH adjusted with alkali to about 7 to 8, and the other ingredients, such as defoamers, pigments and the like, are then added as needed. A solution of the zirconium salt is added last under good agitation.

The surface sizing compound thus prepared is applied to the sheet in the normal manner by a size applicator, such as the size press of the paper machine or a calender water box as mentioned above and well known in the art.

When the surface sizing compound has been applied to the paper or paperboard sheet, the surface sizing compound is immobilized on the surface of the sheet by the zirconium salt through complex formation with the hydroxylated and carboxylated polymer, as the case may be. It is believed that the zirconium salt also forms a complex with the cellulose of the paper at the surface of the sheet, thereby preventing the surface sizing compound to penetrate into the sheet. The zirconium complexes also contain considerable amounts of bound water that prevents crosslinking of the polymer as well as of the cellulose of the paper at the surface of the sheet in the wet state. After the paper or paperboard sheet enters the drying and curing section of the paper machine, the hydrated zirconium complexes are changed by the elimination of water to effect crosslinking of the polymer in the surface sizing compound. The hydrated zirconium complexes also react with the cellulose at the surface of the paper sheet, thereby anchoring the solid polymer of the surface sizing compound to the surface of the paper sheet. The temperature of the drying and curing section of the paper machine is from about 250° to 350° F. The surface temperature of the paper sheet is about 190° to 212° F. during the drying and curing cycle. After drying and curing, the paper sheet should still contain about 4–6 percent moisture to prevent embrittlement of the sheet.

The surface sizing compound of the instant invention is advantageously applied to paper or paperboard that has been filled with calcium carbonate pigment at the wet end of the paper machine. The use of calcium carbonate as a filler pigment is dictated by the desire to produce alkaline paper, rather than acidic paper. The longevity of the paper is very much enhanced by using alkaline ingredients, thus keeping the paper pH above 7. The zirconium salt is especially well suited to form complexes and then crosslink both the polymer of the surface sizing compound and the cellulose of the paper surface because it reacts well with these materials under mildly acidic and alkaline conditions. The zirconium salt also forms complex bonds with ions at the surface of pigments which have been added to the paper or paperboard at the wet end, thereby further strengthening the surface of paper and paperboard. This is not true of previously used crosslinkers, such as amino resins. For example, melamine formaldehyde resins, urea formaldehyde resins, glyoxal based resins, and the like require an strong acidic catalyst for their reaction with both the polymer of the surface sizing compound and the cellulose of the paper surface which prohibits the use of inexpensive alkaline filler pigments, such as calcium carbonate. These afore mentioned resins additionally do not immobilize the surface sizing compound by complex formation, because they do not react in an aqueous environment, thereby causing penetration of the surface sizing compound into the paper or paperboard sheet. They do not complex with pigments. They also emit undesirable formaldehyde vapors into the workplace and environment.

The surface sizing compound of the instant invention provides many advantages for the paper maker. The porosity of the sheet is decreased, thereby improving sizing values. As a result of the more strongly bound surface imparted by the instant invention, the loss of cellulosic fiber and mineral content from the sheet during printing is greatly reduced, resulting in less down time of the printing press. Upon subsequent coating of the paper and paperboard sheets, scratches or streaks are minimized as mentioned later. The amount of mineral filler pigments can be increased in the sheet at the wet end of the paper machine, which reduces the unit cost of the paper and paperboard. The total amount of the surface sizing compound can be reduced because the instant invention allows the surface sizing compound to be used more efficiently, thereby also reducing the level of foam during the sizing operation. The reliance on the internal size for holdout of the surface treatment of the paper sheet is reduced, thereby saving on internal size. The ability to obtain high sizing efficiency with less costly, low viscosity starch such as ammonium persulfate modified starch in the surface sizing compound is an important advantage of the instant invention over previously used processes. The bonds between zirconium ions and polymer in the surface sizing compound as well as between the zirconium ions and the cellulosic fibers, and the zirconium ions and the pigment particles on the surface of the sheet can be broken by a strongly alkaline treatment, thus allowing the paper and paperboard sheet to be repulpable. The zirconium salt orients the carboxylated polymer molecule, such as SMA, in such a way through ionic charges that the hydrophobic portion faces away from the surface of the paper sheet, thereby improving the water resistance and water repellency of the surface sized paper sheet.

The following examples further describe the invention, and are meant to be illustrative without limiting the scope of the instant invention:

EXAMPLE 1

A surface sizing compound was prepared by adding AZC (HTI 5800M, supplied by Hopton Technologies, Inc., Albany, Oreg. was used), containing about 12 to about 18 percent zirconium as calculated as $ZrO_2$, at 4.5 percent "as received" on the dry content of a solution of low molecular weight starch, which had been converted using ammonium persulfate, after cooking and dissolving. The surface sizing compound was applied in the size press to a sheet of paper containing 12 percent precipitated calcium carbonate, dried and cured. This sheet had previously caused excessive dusting, and had caused contamination by calcium carbonate of an offset printing blanket.

After incorporating AZC into the surface sizing compound, dusting and linting of the treated paper sheet were significantly reduced during subsequent paper processing. As a result of reduced dusting, the precipitated calcium carbonate was then increased to 17 percent of the sheet content, causing less dusting and contamination than was experienced printing paper sheets that had a 12 percent calcium carbonate content when AZC was not added to the surface sizing compound.

EXAMPLE 2

A surface sizing compound was prepared by adding AZC (HTI 5800M), containing about 12 to about 18 percent zirconium as calculated as $ZrO_2$, at a level of 5 percent "as received" on the dry content of an ethylated corn starch. The reverse side of a coated board was then treated with the surface sizing compound to bond cellulosic fibers to the surface, and dried and cured. The paperboard later came into contact with a moisture condensate covered chill roll on the paper machine, causing the starch of the surface size to resolubilize and lose its fiber-lay property before AZC was added to the surface sizing compound. After adding AZC to the surface sizing compound, and treating the same paperboard, fiber linting on an off-set printing blanket was substantially reduced as a result of keeping the surface sizing compound at the surface through immobilization, rather than having the starch penetrate the sheet. On drying and curing the sheet, the starch was crosslinked to also impart water resistance to the sheet, since no resolubilization occurred on a chill roll.

EXAMPLE 3

A surface sizing compound was prepared by adding AZC (HTI 5800M) and KZC (HTI 5000), both containing about 12 to about 18 percent zirconium as calculated as $ZrO_2$, supplied by Hopton Technologies, Inc., Albany, Oreg.) respectively, at 5 percent "as received" on the dry content of a 6 percent solution of ethylated converted corn starch (Penford Gum 260 was used, as supplied by Penford Products), and 5 percent of the sodium salt of SMA (NA SMA) as supplied by Hopton Technologies, Inc., Albany, Oreg. as HTI 6620M, and 5 percent of the ammonium salt of SMA ($NH_4$ SMA) as supplied by Hopton Technologies, Inc., Albany, Oreg. as HTI 6625, respectively, both amounts on a dry basis to the dry basis of the ethylated converted corn starch, in order to improve strength and reduce porosity through immobilization of the surface sizing compound near the surface of the sheet and subsequent crosslinking by heat. Results are listed in Tables 1 and 2:

TABLE 1

| | HERCULES SIZE TEST | | |
|---|---|---|---|
| | AZC or KZC not added | AZC added | KZC added |
| Starch Only | 20.8 Seconds | 24.1 Seconds | 22.8 Seconds |
| Starch + $NH_4$ SMA | 24.7 Seconds | 46.5 Seconds | 39.9 Seconds |
| Starch + Na SMA | 20.7 Seconds | 24.8 Seconds | 23.4 Seconds |

HERCULES SIZE TEST METHOD (HST) (80 percent transmittance, 1 percent ink, 1 percent formic acid (higher value in seconds equals more sizing effect and are, therefore, better)(Tappi Test Method T530-PM83 was used)

TABLE 2

| | GURLEY VISCOSITY TEST | | |
|---|---|---|---|
| | AZC or KZC not added | AZC added | KZC added |
| Starch Only | 73 Seconds | 77 Seconds | 77 Seconds |
| Starch + $NH_4$ SMA | 53 Seconds | 67 Seconds | 70 Seconds |
| Starch + Na SMA | 66 Seconds | 84 Seconds | 87 Seconds |

GURLEY POROSITY: Number of seconds for volume of air to pass through a sheet. Higher values equal more sizing effect and are, therefore, better. Higher values mean reduced porosity. (Tappi Test Method T536-OM88 was used)

Both HST and Gurley results demonstrate that a performance of a polymer in the surface sizing compound is significantly enhanced by adding either AZC or KZC, and further, that the effect is even more enhanced when SMA is used in conjunction with the starch.

EXAMPLE 4

A surface sizing compound was prepared by adding AZC (HTI 5800M), containing about 12 to about 18 percent zirconium as calculated as $ZrO_2$, to a 7 percent solution of a low molecular weight starch, which had been converted using ammonium persulfate. Paper was sized, dried and cured and the paper was tested (starch+AZC). Next, 4.5 percent (dry basis on starch solids) sodium salt of SMA was added to the surface sizing compound and paper was sized, dried and cured, and the paper was tested (Starch+$N_4$ SMA). AZC was next added at 4 percent "as received" level, based on the dry content of starch and SMA, to the surface sizing compound; paper was then sized, dried and cured and the paper was tested (Starch+$N_4$ SMA+AZC). The results obtained are listed in Table 3:

TABLE 3

| | HST and Cobb Sizing and Gurley Porosity Tests | | |
|---|---|---|---|
| | HST Sizing | Cobb Sizing | Gurley Porosity |
| Starch + AZC | 72 sec. | 39 g $H_2O/m^2$ | 42 sec. |
| Starch + $NH_4$ SMA | 83 sec. | 33 g $H_2O/m^2$ | 120 sec. |
| Starch + $NH_4$ SMA + AZC | 126 sec. | 31 g $H_2O/m^2$ | 635 sec. |

HERCULES SIZE TEST METHOD (HST) (80 percent transmittance, 1 percent ink, 1 percent formic acid (higher values in seconds equal more sizing effect and are, therefore, better)(Tappi Test Method T530-PM83 was used)

COBB SIZING METHOD (COBB): 70 sec. exposure, weight difference before and after exposure to moisture; lower values equal more sizing effect and are, therefore, better. (Tappi Test Method T441-OM90 was used)

GURLEY POROSITY: Number of seconds for volume of air to pass through a sheet. Higher values equal more sizing effect and are, therefore, better. Higher values mean reduced porosity. (Tappi Test Method T536-OM88 was used)

This example shows again that AZC is very effective when SMA is added to the starch in the surface sizing compound.

EXAMPLE 5

Six percent solutions of four different types of polyvinyl alcohol (PVOH) were prepared by cooking for 40 minutes at 95° C. AZC (HTI 5800M), containing about 12 to about 18 percent zirconium as calculated as $ZrO_2$, was added at 10 percent "as received" AZC to each solution. Each surface sizing compound was applied to a base sheet of bleached white paper with basis weight of 56 Lbs/3000 ft2, internal sizing of 23.3 seconds HST. Each surface sizing compound was applied with a size press (Dow Coater) operating at 30 ft/min. with a nip pressure of 50 psi, and a drum drying temperature of 90° to 100° C. Control runs were conducted without the addition of AZC. A Hercules Size Test was conducted on each paper sheet using 1 percent Formic Acid, Transmittance. The results obtained are listed in Table 4:

TABLE 4

| | HERCULES SIZE TEST | | | | |
|---|---|---|---|---|---|
| Polyvinyl alcohol Type | Mol. Wt. × 1000 | AZC added | Pick-up (lbs/3000 ft$^2$) | HST (sec.) 1 h. | HST(sec) 24 h. |
| 97% hydrolyzed | 44–65 | no | 0.8 lbs | 39.1 | 40.6 |
| | 44–65 | yes | 0.7 lbs | 43.5 | 54.0 |
| 99.3% hydrolyzed | 44–65 | no | 1.2 lbs | 27.5 | 31.4 |
| | 85–146 | yes | 0.7 lbs | 29.8 | 36.2 |
| 87–89% hydrolyzed | 15–27 | no | * | 14.9 | 19.4 |
| | 31–50 | yes | * | 19.6 | 21.7 |
| 87–89% hydrolyzed | 44–65 | no | 1.0 lbs | 37.2 | 37.5 |
| | 85–146 | yes | 0.7 lbs | 44.4 | 45.4 |

* Problems with drier section of the size press prevented obtaining pick-up readings, and sizing values were also reduced.

HERCULES SIZE TEST METHOD (HST) (80 percent transmittance, 1 percent ink, 1 percent formic acid) (higher values in seconds equal more sizing effect and are, therefore, better)(Tappi Test Method T530-PM83 was used)

It should be noted that improved sizing values were obtained, even when the pick-up was low, when AZC was used, due to immobilization of the polyvinyl alcohol containing surface sizing compound. This demonstrates, that reduced levels of the more expensive polyvinyl alcohol may be used in conjunction with AZC to obtain results similar or superior to when using polyvinyl alcohol without the addition of AZC.

EXAMPLE 6

Paperboard which is sized using the process of example 5 is coated off-machine at a first coating station equipped with a blade coater for a first clay coating, and at a second coating station, with an air knife coater to apply a second clay coat. A control is run with paper board that has been sized without adding AZC to the surface sizing compound. The control paper board has developed serious scratches and streaks because loose fibers and pigment on the surface of the paper board accumulate behind the coating blade leading to severe scratching and streaking of the surface of the paperboard. The paper board sized with a surface sizing compound with added AZC (HTI 5800M) does not develop any scratches or streaks on subsequent clay coating.

The results of a coating trial show the beneficial effect of immobilizing the surface sizing compound by including AZC in the surface sizing compound. Very few scratches or streaks appear in the coated surface of the paperboard.

EXAMPLE 7

A surface sizing compound was prepared by cooking a 6 percent solution of starch (AMAIZO 791D, manufactured by the American Maize Products Company) was used, adding the same amount of #1 filler clay to the starch solution, that the weight ratio on a dry basis is 50–50 starch and clay, and finally, mixing in AZC (HTI 5800M, supplied by Hopton Technologies, Inc., Albany, Oreg.), containing about 12 to about 18 percent zirconium as calculated as $ZrO_2$, at 6 percent "as received" on the dry content of starch. A paper sheet with a basis weight, of 44 lbs/300 ft$^2$, that was internally sized with alkylketene dimers of long-chain fatty acids, was surface sized on a size press (Dow Laboratory Coater) at 30 feet/minute speed, a nip pressure of 40 psi and a drying drum temperature of 80° C. with the surface sizing compound thus prepared. Test results are listed in Table 5:

TABLE 5

HST and Cobb Sizing and Gurley Porosity Tests

| | HST Sizing | Cobb Sizing | Gurley Porosity |
|---|---|---|---|
| NO AZC added | 55.8 sec. | 39.8 g $H_2O/m^2$ | 20.1 sec. |
| AZC added | 72.5 sec. | 38.9 g $H_2O/m^2$ | 23.7 sec. |

HERCULES SIZE TEST METHOD (HST) (80 percent transmittance, 1 percent ink, 1 percent formic acid) (higher values in seconds equal more sizing effect and are therefore better)(Tappi Test Method T530-PM83 was used)

COBB SIZING METHOD (COBB): 70 sec. exposure, weight difference before and after exposure to moisture; lower values equal more sizing effect and therefore better. (Tappi Test Method T441-OM90 was used)

GURLEY POROSITY: Number of seconds for volume of air to pass through a sheet. Higher values equal more sizing effect and therefore better. Higher values mean reduced porosity. (Tappi Test Method T536-OM88 was used)

It can be seen from the results that the ink in the HST test is retained longer on the surface when AZC was used in the surface sizing compound, which shows the beneficial effect of AZC. Often a mottled ink effect is observed in the HST test when no AZC is used in the surface sizing compound, indicating a non uniform surface of the sheet because the starch surface size penetrated the sheet unevenly. This is prevented when using AZC in the surface sizing compound.

What is claimed is:

1. A process of sizing the surface of paper or paperboard comprising the following steps a) preparing an aqueous surface sizing compound by combining and mixing an aqueous solution of at least one water soluble or dispersible polymer or interpolymer, a solution or dispersion of auxiliary materials, and an aqueous solution of a metal salt, selected from the group of metals consisting of zirconium, hafnium and titanium;

b) adjusting the pH of said aqueous sizing compound from about 5 to about 10.5 by the addition of alkali, thereby increasing the molecular weight of said polymer or interpolymer by chemically or physically reacting said polymer or interpolymer with said salt of zirconium, hafnium or titanium, resulting in an increase in viscosity of said aqueous sizing compound;

c) applying said aqueous surface sizing compound to the surface of the paper or paperboard by means of a size press or a calender waterbox, to immobilize said aqueous sizing compound on the surface of said paper or paperboard in the wet state thereby preventing penetration of said aqueous surface sizing compound into said paper or paperboard; and d) drying and curing said aqueous surface sizing compound by applying heat to the treated paper or paperboard thereby crosslinking said polymer or interpolymer contained in said surface sizing compound, and also forming bonds with the pigment particles and fiber present at the surface of said paper or paperboard, and thereby anchoring the polymer or interpolymer to the surface of said paper or paperboard.

2. The process of claim 1, wherein said aqueous surface sizing compound consists essentially of

| | |
|---|---|
| 50–70 parts | water soluble hydroxylated polymer |
| 0–7 parts | water soluble carboxylated polymer |
| 0.3–3 parts | alkali salt of zirconium carbonate (calculated as $ZrO_2$) |
| 0–7 parts | polymeric additive |
| 0–2 parts | aqueous alkali |
| 0–80 parts | pigment |

and enough water to obtain from 2 to 14 percent total solids.

3. The process of claim 2, wherein said water soluble hydroxylated polymer is selected from the group consisting of corn starch, potato starch, rice starch, tapioca starch and polyvinyl alcohol.

4. The process of claim 2, wherein said water soluble hydroxylated polymer is a chemically or biologically modified starch.

5. The process of claim 2, wherein said water soluble hydroxylated polymer is selected from the group consisting of sodium alginate, carrageenan, guar gum, gum arabic, gum ghatti, gum karaya, gum tragacanth, locust bean gum, pectin, xanthan gum, and tamarind gum.

6. The process of claim 2, wherein said water soluble hydroxylated polymer is a chemically modified cellulose.

7. The process of claim 2, wherein said water soluble carboxylated polymer is selected from the group consisting of salts of styrene-maleic anhydride interpolymer, salts of styrene-acrylic acid interpolymer, salts of acrylic or methacrylic acid, salts of vinyl acetate-crotonic acid interpolymer, and salts of ethylene-acrylic acid interpolymer.

8. The process of claim 2, wherein said polymeric additive is selected from the group consisting of polyurethanes, polyesters, polyamides, and epoxy resins.

9. The process of claim 2, wherein said alkali salt of zirconium carbonate is selected from the group consisting of potassium zirconium carbonate and ammonium zirconium carbonate

10. The process of claim 2, wherein said pigment is selected from the group consisting of calcium carbonate, clay, titanium dioxide, talc, and silica.

11. The process of claim 2, wherein said aqueous alkali is selected from the group consisting of aqueous solutions of ammonium hydroxide, sodium hydroxide, potassium hydroxide, and sodium carbonate.

12. The process of claim 1, wherein said aqueous surface sizing compound has a solids content from 1.5 to 20 percent.

13. The process of claim 2, wherein said water soluble hydroxylated polymer is a partially hydrolyzed polyvinyl alcohol.

14. The process of claim 2, wherein said water soluble hydroxylated polymer is a fully hydrolyzed polyvinyl alcohol.

15. The process of claim 2, wherein said water soluble hydroxylated polymer is an ethylated converted corn starch.

16. The process of claim 2, wherein said water soluble hydroxylated polymer is a low molecular weight starch, which has been converted using ammonium persulfate.

17. The process of claim 2, wherein said pigment is calcium carbonate.

18. Paper or paperboard sheets produced by the process of claim 1.

19. The process of claim 2, wherein said aqueous surface sizing compound includes a small amount of defoamer.

* * * * *